US008516707B2

(12) United States Patent
Castley et al.

(10) Patent No.: US 8,516,707 B2
(45) Date of Patent: Aug. 27, 2013

(54) HAND HELD IMPLEMENT

(76) Inventors: James Anthony Castley, Kings Park Marayong (AU); Simon Gene Castley, Hong Kong (CN)

( * ) Notice: Subject to any disclaimer, the term of this patent is extended or adjusted under 35 U.S.C. 154(b) by 378 days.

(21) Appl. No.: 12/863,721

(22) PCT Filed: Jan. 22, 2009

(86) PCT No.: PCT/AU2009/000063
§ 371 (c)(1),
(2), (4) Date: Oct. 5, 2010

(87) PCT Pub. No.: WO2009/092132
PCT Pub. Date: Jul. 30, 2009

(65) Prior Publication Data

US 2011/0047801 A1 Mar. 3, 2011

(30) Foreign Application Priority Data

Jan. 22, 2008 (AU) ..... 2008900259

(51) Int. Cl.
*B26B 13/16* (2006.01)
*B26B 13/20* (2006.01)

(52) U.S. Cl.
USPC ..... 30/232; 30/261; 30/262

(58) Field of Classification Search
USPC ..... 30/231, 232, 254, 261, 262
See application file for complete search history.

(56) References Cited

U.S. PATENT DOCUMENTS

| | | | | |
|---|---|---|---|---|
| 309,889 | A * | 12/1884 | Shepard | 30/262 |
| 1,546,317 | A * | 7/1925 | Rogers | 30/262 |
| 2,674,796 | A * | 4/1954 | Herold | 30/262 |
| 3,416,226 | A * | 12/1968 | Pfaffenbach | 30/261 |
| 4,073,059 | A * | 2/1978 | Wallace et al. | 30/261 |
| 4,114,268 | A * | 9/1978 | Hildebrandt et al. | 30/262 |
| 5,179,783 | A * | 1/1993 | Melter | 30/262 |
| 5,297,343 | A * | 3/1994 | Melter et al. | 30/262 |
| 5,377,412 | A | 1/1995 | Schofield et al. | |
| 5,628,117 | A | 5/1997 | Glesser | |
| 6,212,780 | B1 | 4/2001 | Huang | |
| 6,301,787 | B2 * | 10/2001 | Mock | 30/262 |
| 6,336,272 | B1 * | 1/2002 | Lee | 30/262 |
| 6,594,906 | B1 | 7/2003 | Sakai et al. | |
| 6,641,595 | B1 | 11/2003 | Moran et al. | |
| 6,725,547 | B2 * | 4/2004 | Wu | 30/254 |
| 7,100,481 | B2 * | 9/2006 | Hartranft et al. | 81/417 |

(Continued)

FOREIGN PATENT DOCUMENTS

| | | |
|---|---|---|
| DE | 20218311 U1 | 1/2003 |
| EP | 1733854 | 12/2006 |

*Primary Examiner* — Hwei C Payer
(74) *Attorney, Agent, or Firm* — George A. Leone; Citadel Patent Law

(57) ABSTRACT

An embodiment of the hand held implement is in the form of a pair of scissors (10), as shown for example in FIG. 1. The pair of scissors include a pair of blades (12, 13) which are pivotally mounted about pivot pin (11). The blades are fitted with plastic loop portions which form the handles (14, 15) of the scissors (10). Handle (15) includes a moveable portion in the form of gate (16) which is pivotally mounted about pin (18). Handle (14) is fitted with a latching arrangement in the form of a slidably moveable (latch 20) which cooperates with a T-shaped lug (24) (visible in FIGS. 2, 5*a* and 5*b*) to retain the handles together in a closed position, or to allow the handles to be separated.

6 Claims, 11 Drawing Sheets

(56) References Cited

U.S. PATENT DOCUMENTS

| | | | | |
|---|---|---|---|---|
| 7,694,423 | B2 * | 4/2010 | Hasegawa | 30/232 |
| 8,079,150 | B2 * | 12/2011 | Huang | 30/254 |
| 2005/0144730 | A1 | 7/2005 | Barber et al. | |
| 2006/0191142 | A1 * | 8/2006 | Jou | 30/262 |
| 2007/0144015 | A1 * | 6/2007 | Peterson et al. | 30/262 |
| 2008/0184567 | A1 * | 8/2008 | Jou | 30/262 |
| 2009/0271987 | A1 * | 11/2009 | Fisher | 30/123 |
| 2011/0047801 | A1 * | 3/2011 | Castley et al. | 30/232 |

* cited by examiner

HAND HELD IMPLEMENT

TECHNICAL FIELD

The present invention relates to hand held implements such as scissors and writing instruments and particularly relates to modifications to hand held implements to enhance ease of storage.

SUMMARY OF THE INVENTION

In a first aspect the present invention provides a hand held implement including: a loop portion; the loop portion having a moveable section which is moveable from a first position in which it is contiguous with the loop portion to a second position wherein the loop portion is interrupted; and wherein movement of the moveable section activates a function of the hand held implement.

The loop portion may form a handle of the implement.

The moveable section may be arranged to only move in a direction inwardly of the loop portion.

The moveable section may be pivotally moveable.

The moveable section may be mounted to the remainder of the loop portion by way of a pin and is arranged to pivot about the pin.

The function activated by the moveable section may include a latching arrangement.

The hand held implement may include pivotally mounted blades and the latching arrangement operates to retain the blades in a closed position.

The moveable section may include at least one projection which activates the latching arrangement.

The latching arrangement may include a latch which is slidably moveable.

In one embodiment the hand held implement is a pair of scissors having a pair of blades respectively connected to a pair of handles, at least one of handles defining the loop portion, wherein the latch is disposed intermediate the handles. Preferably the scissors further have a scissor pivot for pivotally connecting the blades and handles, and the latch is disposed adjacent to an end of at least one of the handles proximate to the scissor pivot.

Another embodiment includes a latch retainer adapted to releasably retain the latch in a position whereby the blades are retained in a closed position. Preferably the latch retainer is adapted for operation only by users exceeding an approximate target age.

The hand held implement may include a barrel and an ink delivery device, and the moveable section activates the function of retracting the ink delivery device into the barrel.

A second aspect the present invention provides a hand held implement including: two pivotally mounted blades; a loop portion forming a handle associated with at least one of the blades; the loop portion having a moveable section which is moveable from a first position in which it is contiguous with the loop portion to a second position wherein the loop portion is interrupted; and wherein the moveable section may only move inwardly of the handle.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENT

Figure 1:
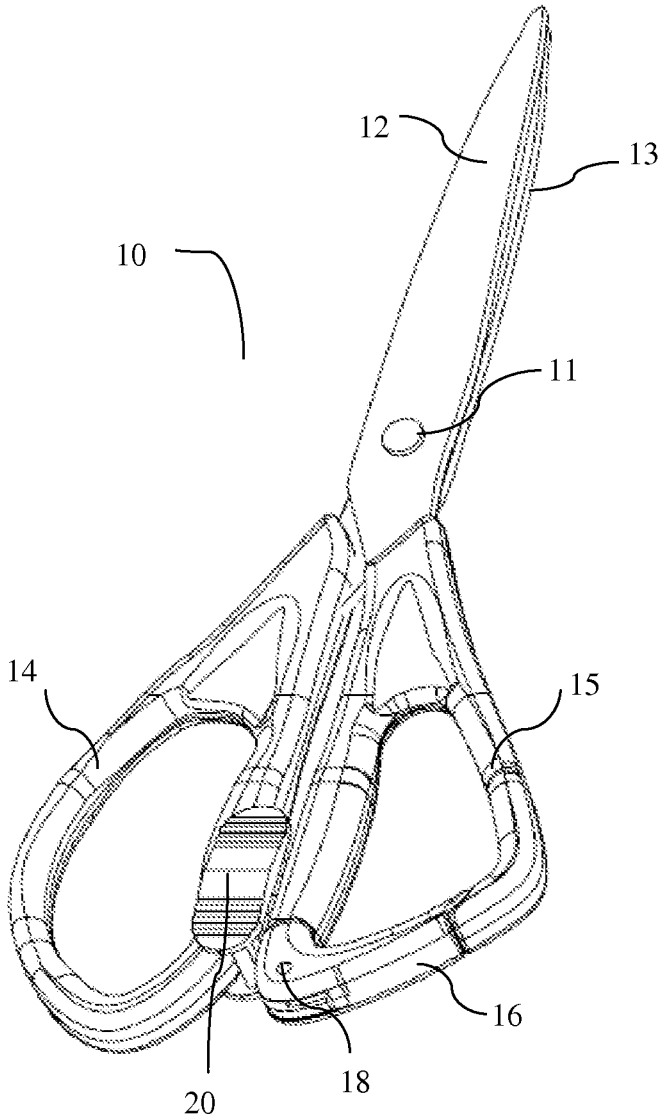
FIG. 1 is a perspective view of a first embodiment of a pair of scissors according to the invention.

Referring to FIG. 1, a hand held implement in the form of a pair of scissors 10 is shown including a pair of blades 12, 13 which are pivotally mounted about pivot pin 11. The blades are fitted with plastic loop portions which form the handles 14, 15 of the scissors 10. Handle 15 includes a moveable portion in the form of gate 16 which is pivotally mounted about pin 18. Handle 14 is fitted with a latching arrangement in the form of a slidably moveable latch 20 which cooperates with a T-shaped lug 24 (visible in FIGS. 2, 5*a* and 5*b*) to retain the handles together in a closed position, or to allow the handles to be separated.

Figure 2:
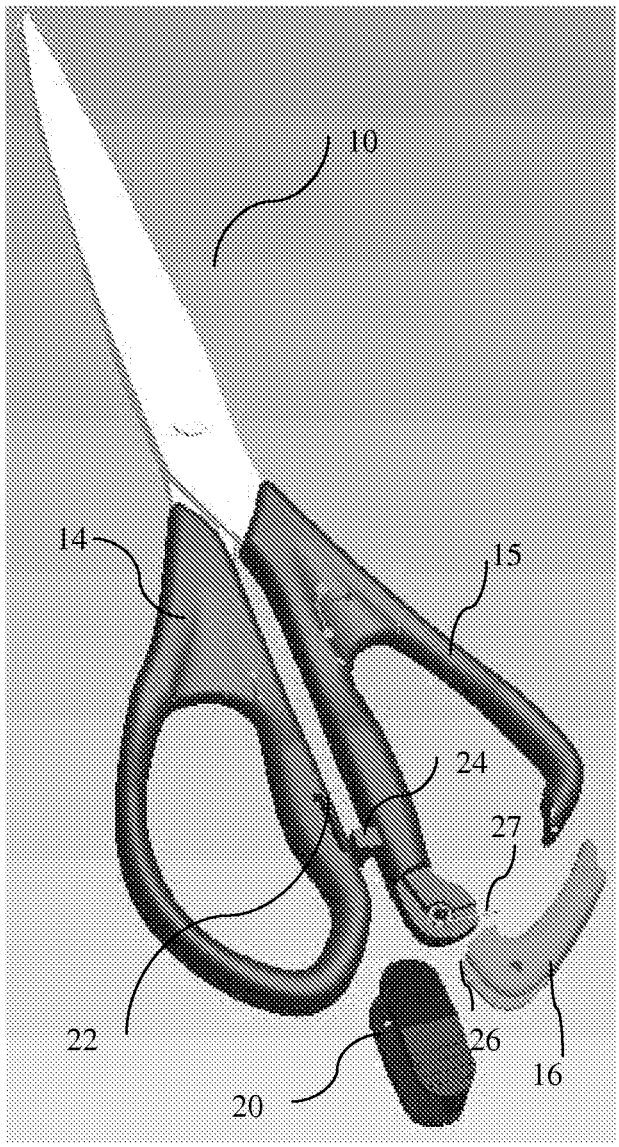
FIG. 2 is a part exploded view of the pair of scissors of FIG. 1.

Referring to FIG. 2, the scissors 10 are shown in part exploded view. Gate 16 has been removed to expose coil spring 27 which biases gate 16 to its first position as shown in FIG. 1 wherein the gate 16 is contiguous with the handle 15. Latch 20 has also been removed to expose groove 22 which is used to mount the latch 20 and in which the latch 20 slides between the open and closed positions. In the closed position, latch engages with lug 24 to retain the handles 14, 15 together and thus prevent separation of blades 12, 13. Gate 16 includes a projection 26 which cooperates with latch 20.

Figure 3:
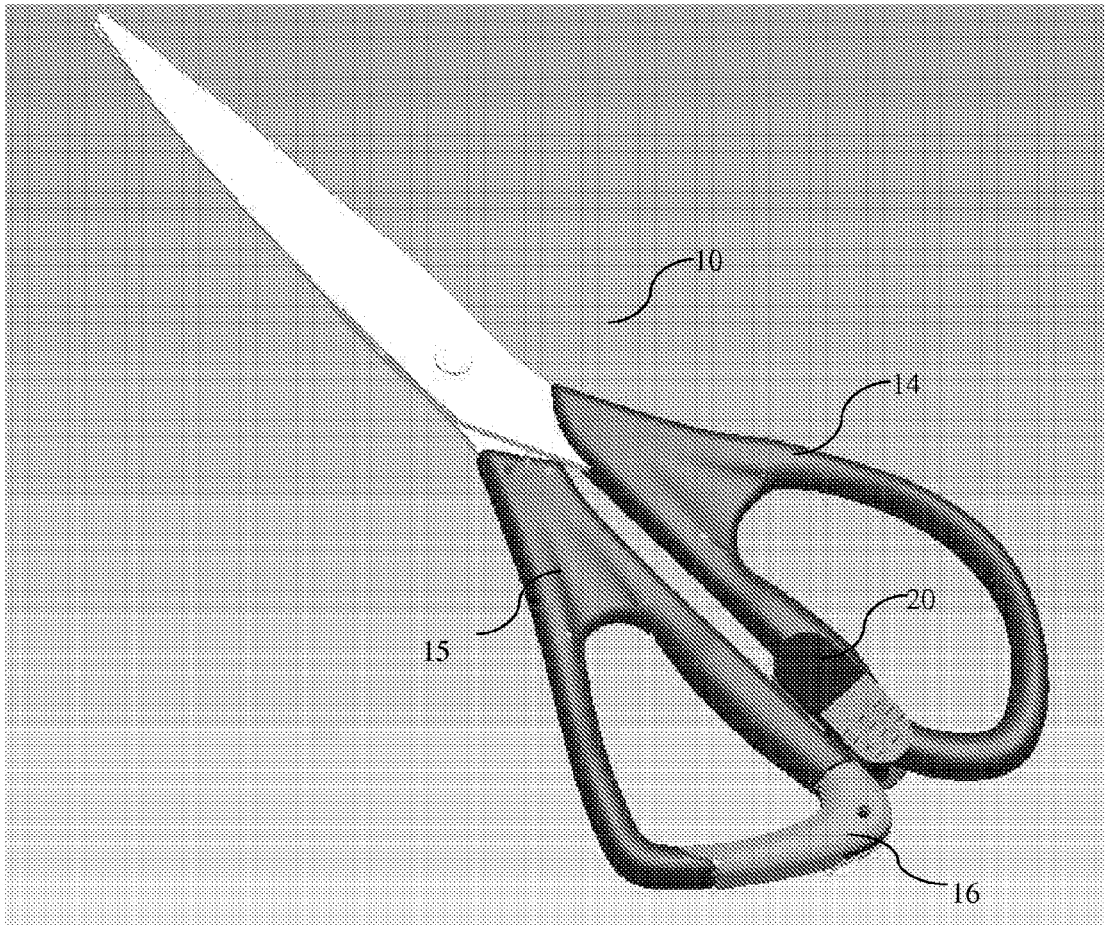
FIG. 3 shows the pair of scissors of FIG. 1 with the latch in the open position and the handles brought together.

Pivotal movement of gate 16 activates a function of the scissors 10. That is, movement of the gate activates latch 20, as will now be described with reference to FIGS. 3, 4, 5*a* and 5*b*. Referring to FIGS. 3, 5*a* and 5*b*, the latch 20 is in the open position and the handles 14 and 15 of the scissors 10 have been brought together. As best shown in the cross-section of FIG. 5*b*, in the open position, an intermediate portion 21 of the latch 20 has radial clearance from the lug 24 so as to allow separation of the handles 14 and 15 via rotation of at least one of the handles away from the other handle. This separating rotation occurs about an axis defined by the pivot pin 11.

Figure 4:
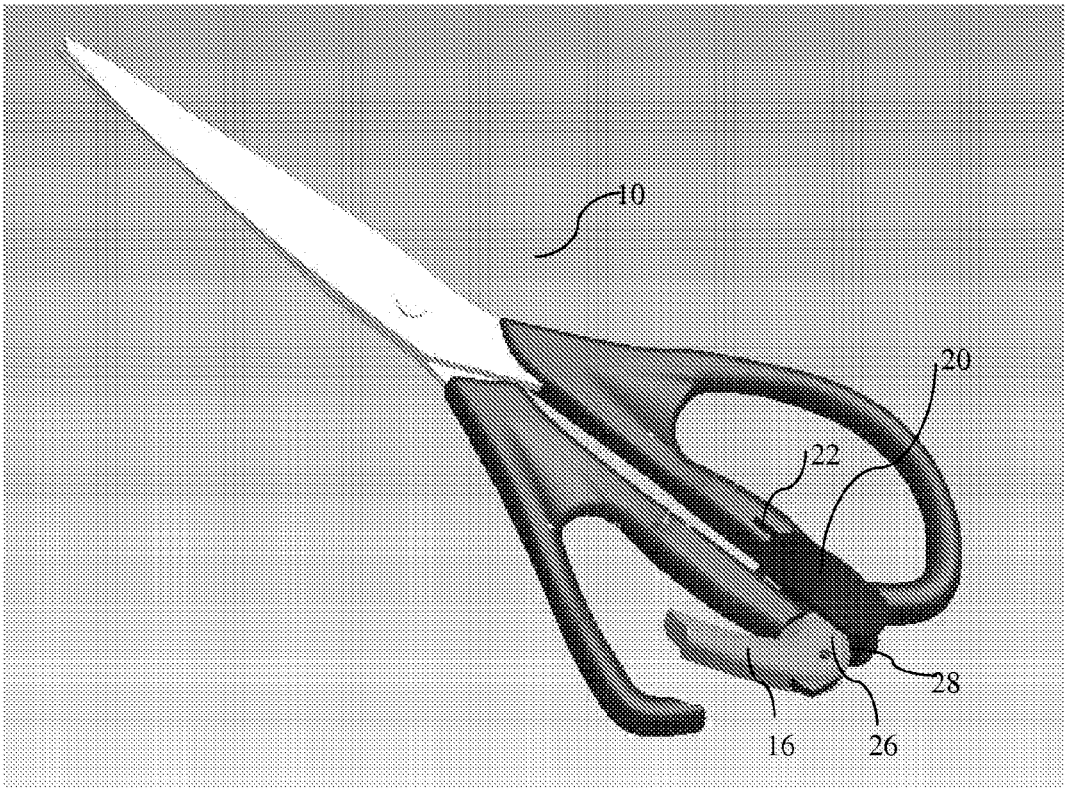
FIG. 4 shows the pair of scissors of FIG. 1 with the gate in the open position and the latch in the closed position.
Figure 5A:
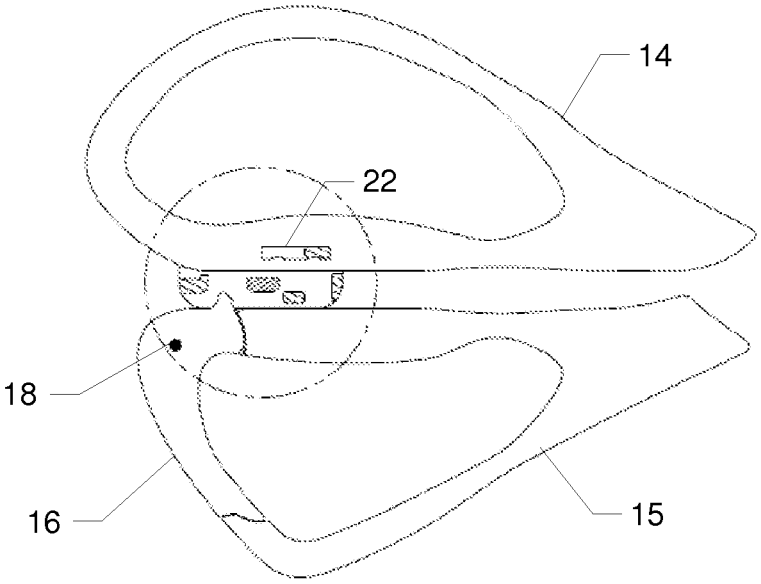
FIG. 5*a* shows the handles of the pair of scissors of FIG. 1 with the a central cross-section of the latch being depicted in the open position.
Figure 5B:
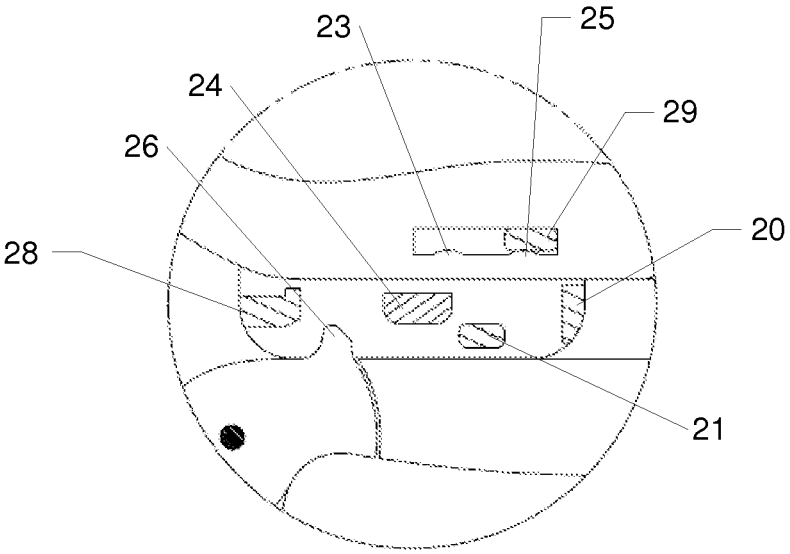
FIG. 5*b* is a magnified view of the dashed circle of FIG. 5*a* showing the latch cross-section.

Now referring to FIG. 4, the gate 16 has been rotated inwardly of handle 15 to its second position, thereby causing an interruption to the loop portion in the form of a gap between gate 16 and the remainder of handle 15. The projection 26 of gate 16 has engaged with a ridge 28 provided on latch 20 and has moved latch along its groove 22 (note that a portion of groove 22 is now visible in FIG. 4 due to lateral movement of the latch 20). In this position, the intermediate portion 21 of the latch 20 engages with lug 24 to retain the handles 14 and 15 of the scissors together and the latch is said to be in the closed position. In other words, when the latch 20 is in the closed position, the relative radial positions of the lug 24 and the intermediate portion 21 of the latch 20 do not allow for separation of the handles 14 and 15 via rotation of at least one of the handles away from the other handle. The gate 16 returns to its position as shown in FIG. 3 due to resilient biasing in the form of coil spring 27.

A pair of detents 23 and 25 are provided within the groove 22 so as to interact with the portion 29 of the latch 20 that is disposed within the groove. The detents 23 and 25 provide points of slight physical resistance at either end of the range of sliding movement of the portion 29 of the latch 20 within the groove 22. This slight physical resistance helps to retain the latch 20 at either the open position (when portion 29 is adjacent detent 25) or the closed position (when portion 29 is adjacent detent 23). Additionally, the detents provide the user with an indication that a limit of the range of movement of the latch 20 has been reached.

To use scissors 10, one first slides latch 20 to the open position as shown in FIG. 3 thereby allowing handles 14, 15 to be separated. The scissors 10 may then be used in the conventional manner to cut material as desired. After use, the scissors 10 may be efficiently and safely stored by use of the gate and latch mechanism. For instance, the scissors may be stored on a hanging rail by bringing the gate 16 to bear against the rail so that the gate 16 rotates inwardly of handle 15. The rail may then be admitted through the gap into the loop of handle 15. At the same time, the gate 16 causes sliding movement of latch 20 to bring it to its closed position to retain the handles 14, 15 together and thus retain the blades 12, 13 together. When the rail is inside handle loop 15 the gate 16 springs back to become contiguous with handle 15 and the handle 15 now surrounds the rail. It is to be noted that gate 16 may only move inwardly of handle 15 and is prevented from moving outwardly by engagement of the free end of gate 16 with handle 15. Thus, the rail cannot escape from the handle 15 and so the scissors 10 are securely attached to the rail. At the same time, latch 20 prevents the blades 12 and 13 from separating, thus reducing risk of injury to a person who might accidentally come into contact with the scissors 10. To remove the scissors from the rail, it is necessary to rotate gate 16 inwardly by pressing on the gate by hand to open the gate to allow the rail to escape from the handle 15.

Figure 6:
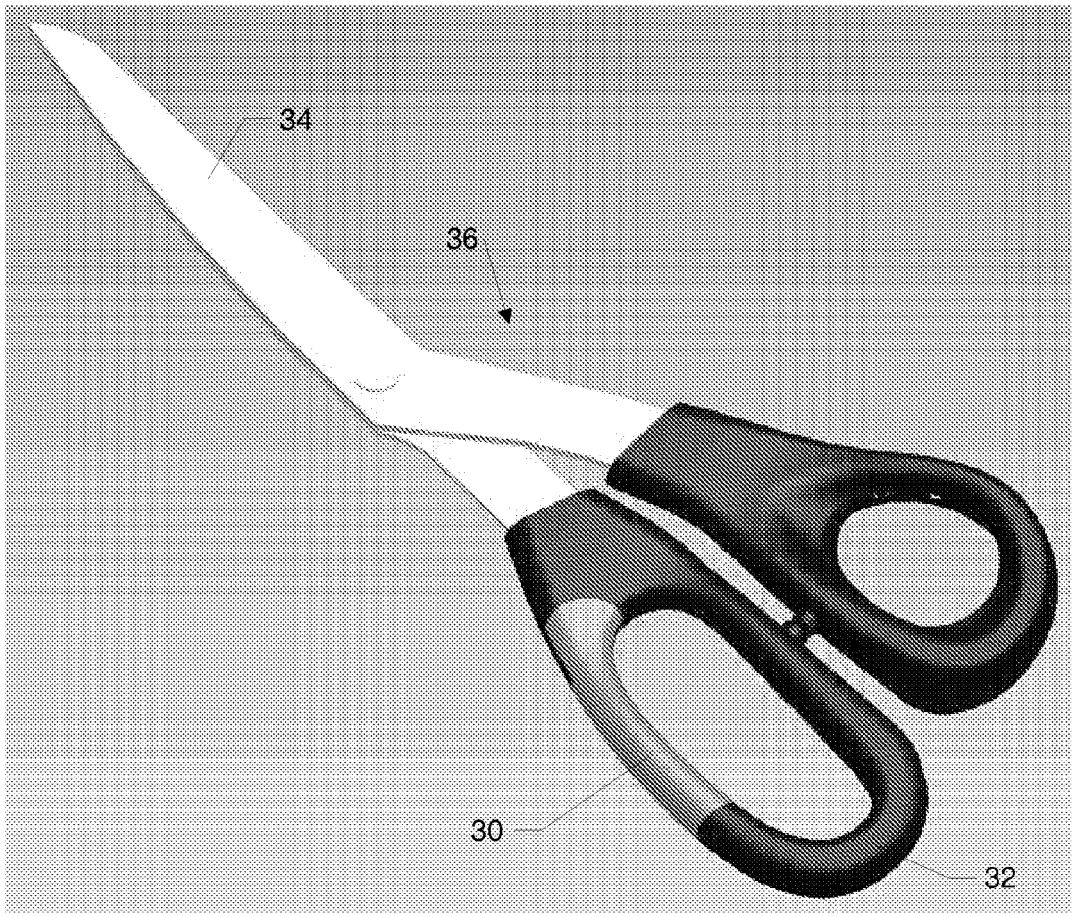
FIG. 6 shows a perspective view of a second embodiment of a pair of scissors according to the invention with the gate in the closed position.
Figure 7:
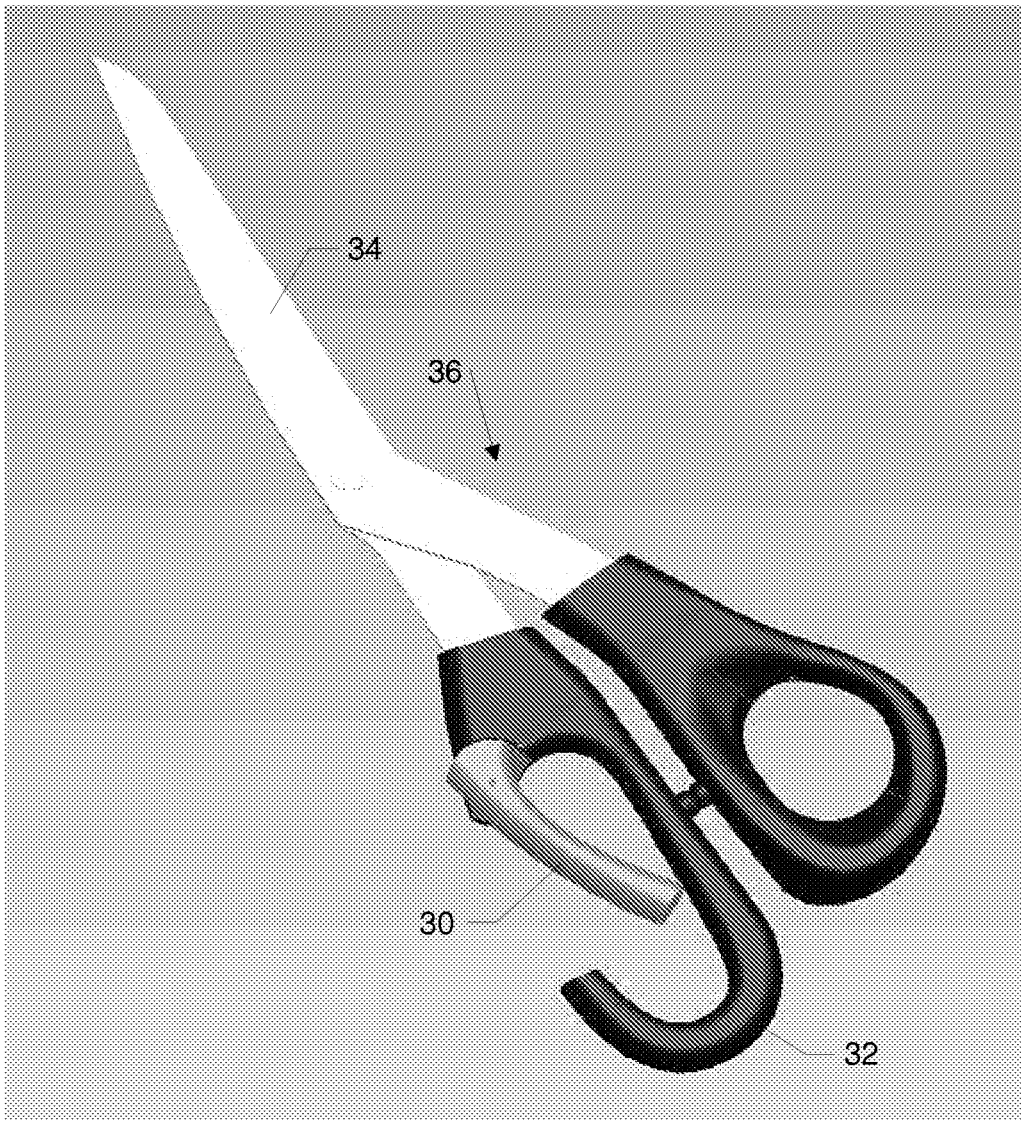
FIG. 7 shows a perspective view of the second embodiment of the pair of scissors with the gate in the open position.

In the embodiment described above, the gate 16 was provided along a top edge of a handle 15 of the scissors 10. However, in the embodiment illustrated in FIGS. 6 and 7, the gate 30 is provided along a side edge of the handle 32. In this embodiment, by holding the blades 34 of the scissors 36 together in one hand, the scissors may be affixed to a rail or the like with a natural sweeping side wards movement of the forearm to strike gate 30 against the rail. The momentum of the arm of the user assists in providing the force necessary to open gate 30 against biasing of the coil spring. This embodiment dispenses with the latch and hence the gate 30 is provided solely to promote ease of storage.

Figure 8:
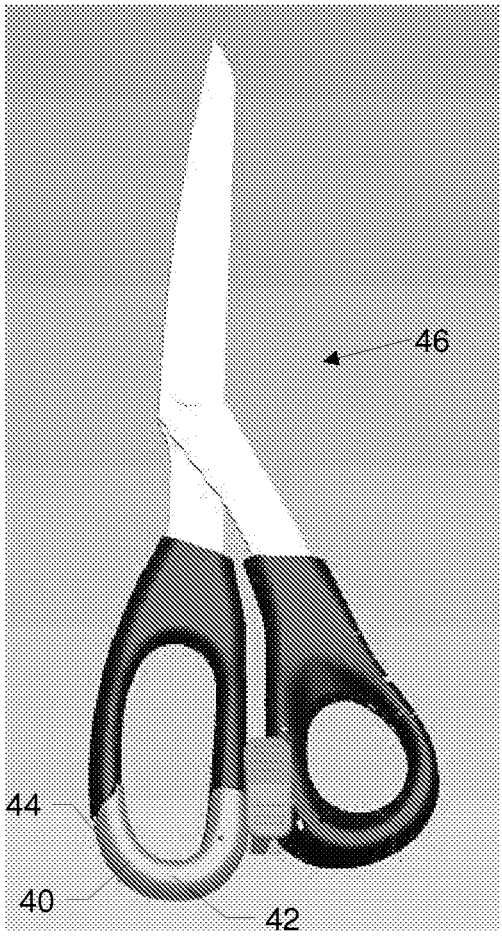
FIG. 8 shows a perspective view of a third embodiment of a pair of scissors according to the invention with the gate in the closed position.
Figure 9:
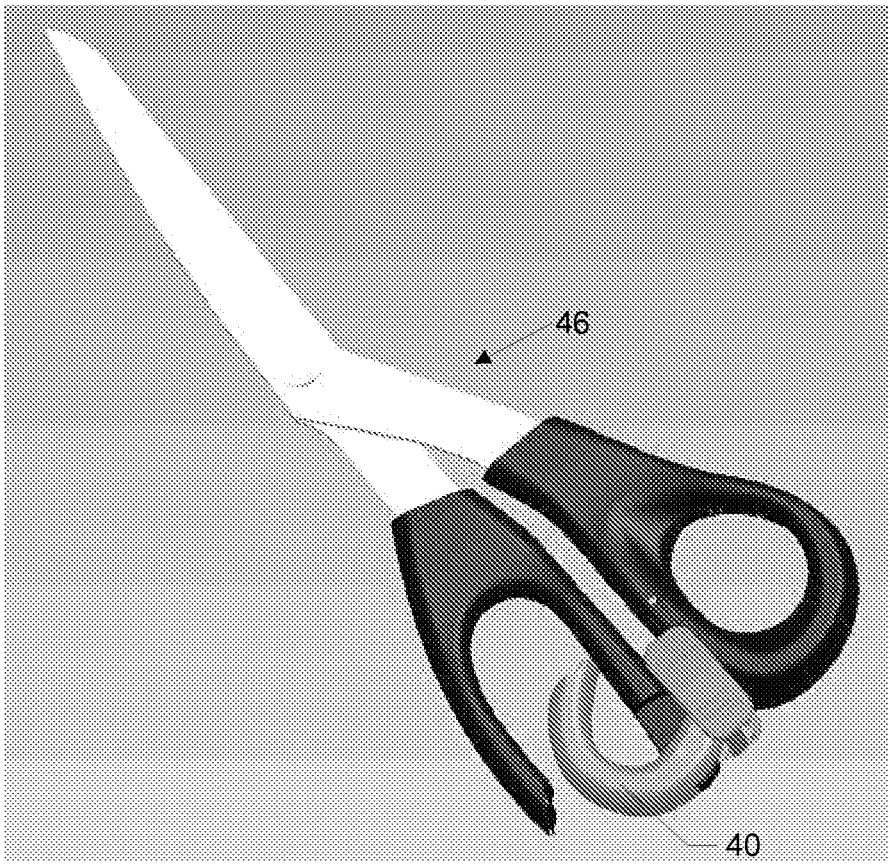
FIG. 9 shows a perspective view of the third embodiment of the pair of scissors with the gate in the open position.

In the embodiment illustrated in FIGS. 8 and 9, the gate 40 is arcuate and hence defines an end 42 and a side 44 of the handle. This provides the user with an option to attach this embodiment to a rail or the like by using various techniques. For example, the scissors 46 may be displaced linearly in a longitudinal direction such that the end 42 of the gate bears against the rail so as to affix the scissors 46 to the rail in a manner akin to that described above with reference to the embodiment shown in FIGS. 1 to 5. Alternatively, the scissors 46 may be affixed to the rail using the natural sweeping sidewards movement described in the preceding paragraph so as to bear the side 44 of the gate against the rail. This embodiment includes a latch, which functions as described above with reference to the embodiment shown in FIGS. 1 to 5.

In the scissors 49 illustrated in FIGS. 10 to 13, the rotatably mounted end 50 of the gate 51 is disposed adjacent a proximal end 52 of the larger handle 53. Hence, the pivot pin 54 of the gate 51 is disposed relatively close to the main pivot pin 55 of the scissors. The gate 51 terminates at its free end 56 at approximately half way along a side of the larger handle 53. In a similar manner to that described with reference to the embodiment shown in FIGS. 6 and 7, this positioning of the gate 51 allows the scissors 49 to be stored onto a rail or the like with a natural sweeping sideways movement of the user's forearm.

In FIGS. 10 to 13 the latch 57 is shown in the open position. In the same manner as described with reference to the embodiment of FIGS. 1 to 5, inwards movement of the gate 51 displaces the latch 57 into the closed position so as to prevent separation of the handles 53 and 58, thereby locking the scissors 49. Whilst using the scissors 49 in the ordinary fashion as a cutting tool, a user's index, or other, finger is typically positioned adjacent the proximal end of the loop formed by the larger handle 53. Once the user has concluded cutting, the user may slip their index finger, or one of their other fingers, out of the loop formed by the larger handle 53 so as to allow the finger to engage the outer surface of the gate 51. The index finger may then displace the gate 51 inwardly so as to lock the scissors 49. Alternatively, if a user grasps the scissors 49 with the blade end 59 across the palm of their hand, the user's thumb or one of their fingers may naturally rest upon the gate 51. This once again allows for convenient locking of the scissors 49 via rotation of the gate 51. The relative ergonomic ease of such locking movements encourages use of the locking safety feature, even if the scissors 49 are not stored onto a rail or the like.

The use of the gate 51 to displace the latch 57 from the open position to the closed position provides extra leverage as compared to directly applying a force to the latch 57. Hence, less force is required to lock the scissors 49 when using the gate 51 to do so as compared to a user directly exerting a force onto the latch 57. This contributes to ease of locking the scissors and also potentially therefore encourages more consistent use of the locking safety feature.

The latch 57 is disposed intermediate the two handles 53 and 58 and in this embodiment of the scissors 49 the latch 57 is relatively close to the main scissor pivot pin 55. More particularly, the latch 57 is disposed adjacent to an end of at the smaller handle 58 that is proximate to the scissor pivot 55. Hence, when viewed from the side, such as in FIGS. 10 and 12, the latch 57 is effectively surrounded by the two handles 53 and 58 and by the scissor pivot region. This positioning advantageously reduces the risk of the latch 57 being inadvertently knocked and displaced from the closed to the open position. Rather, to unlock this embodiment of the scissors 49, the user must typically position a thumb and a finger on the latch 57 on either side of the scissors 49 so as to frictionally engage the latch 57 to displace it from the closed position to the open position. Engagement formations in the form of arcuate ridges are disposed on the sides of the latch 57 to assist with such frictional engagement. Additionally, the sides of the latch 57 are slightly concave to further assist with such frictional engagement.

Figure 10:
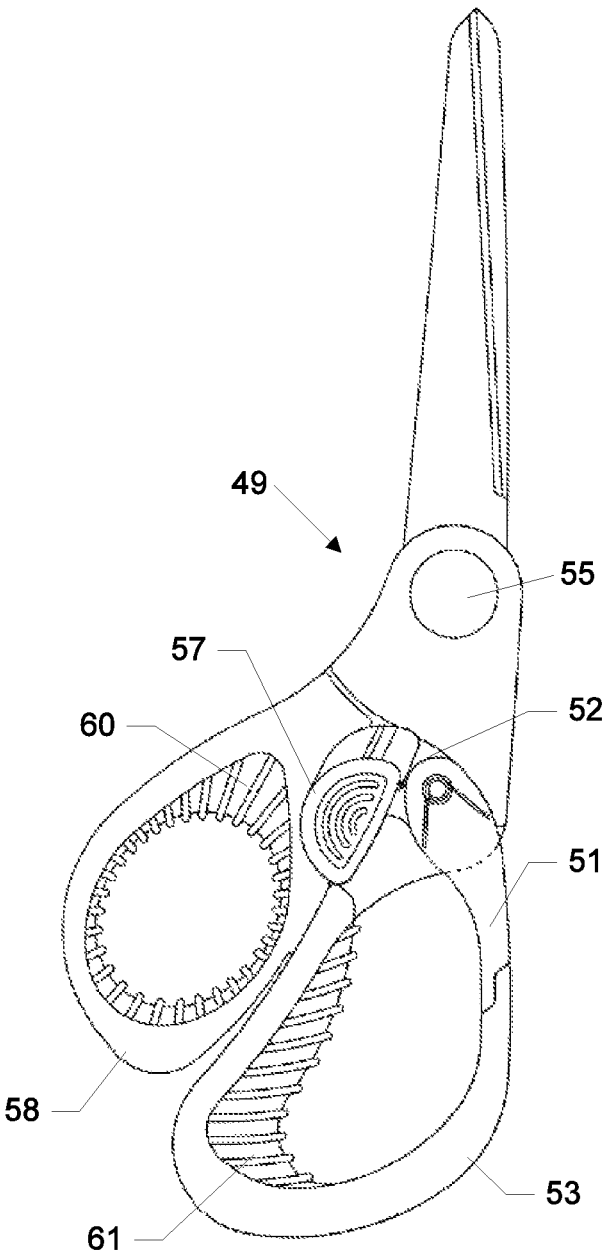
FIG. 10 is a right side view of a fourth embodiment of a pair of scissors according to the invention.
Figure 11:
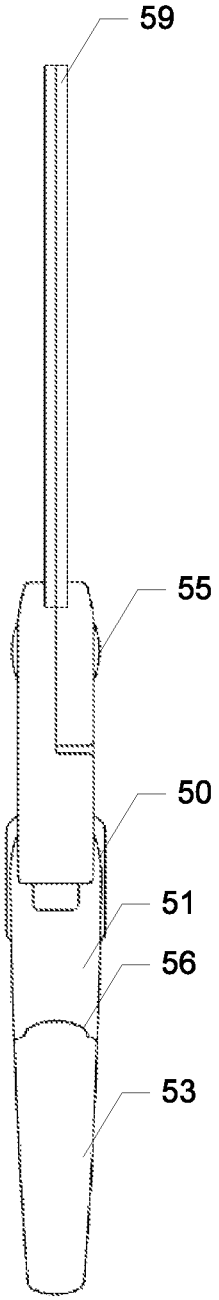
FIG. 11 is a bottom view of the fourth embodiment.
Figure 12:
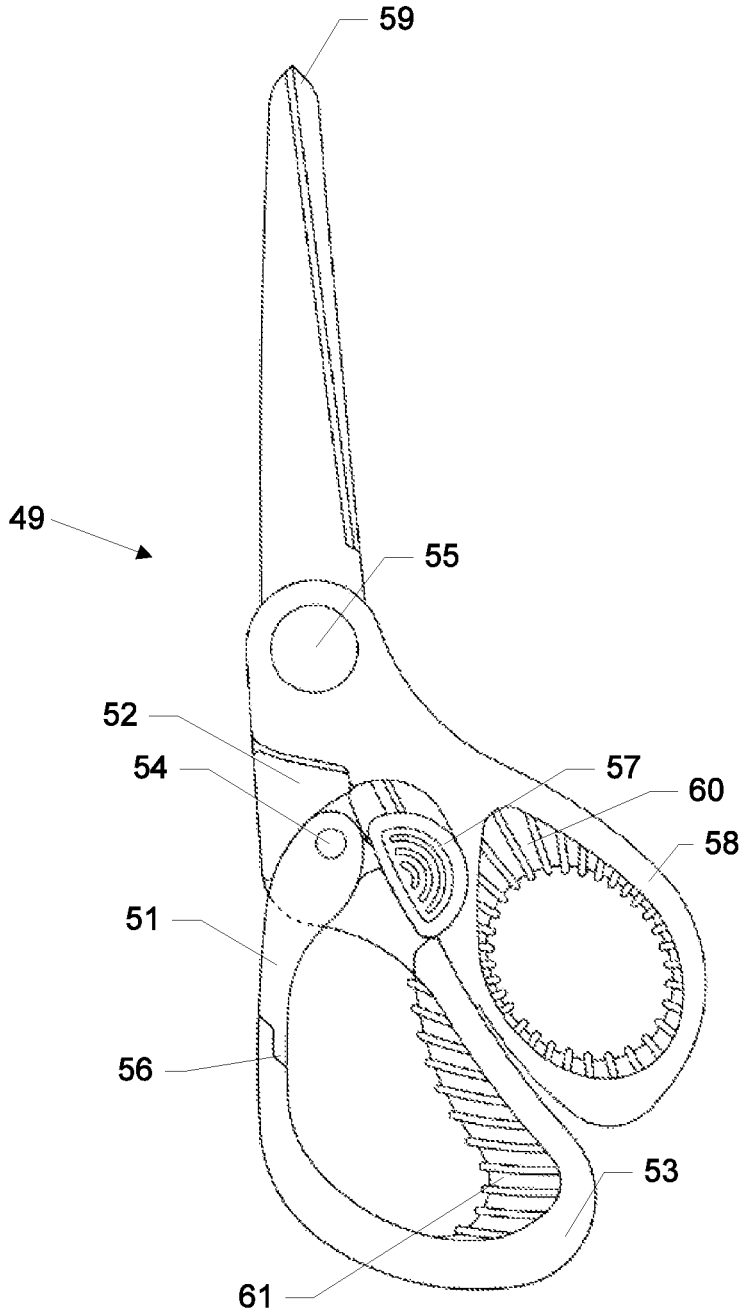
FIG. 12 is a left side view of the fourth embodiment.
Figure 13:
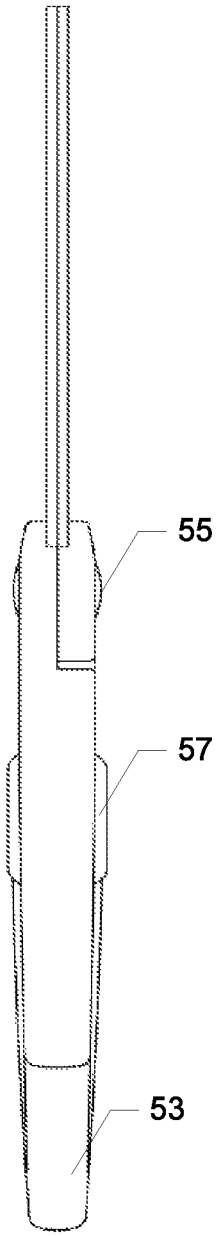
FIG. 13 is a plan view of the fourth embodiment.

The coil spring that biases the gate 51 into its first position in which it is continuous with the loop of the larger handle 53 is shown in FIG. 10, however in practice this coil spring is housed within the gate 51 and is not generally visible externally of the scissors 49.

The curved ribbed sections 60 and 61 on this embodiment are preferably constructed from a relatively soft material so as to promote comfortable use of the scissors 49.

In other embodiments (not illustrated) the latch is automatically retained in the closed position in a child-proof manner such that typically only a user exceeding a predetermined approximate target age, such as an adult for example, can easily displace the latch from the closed to the open position. This is achieved with the use of a latch retainer. One option for such a latch retainer is a detent over which the latch must be displaced to move from the closed position to the open position. Displacing the latch in this manner requires a comparatively large amount of force, which is likely to be difficult for a user who is under an approximate target age to exert. Another option for a latch retainer is a lug, which is disposed on the scissors adjacent the closed position of the latch. This lug resiliently engages the latch when the latch is moved into the closed position to thereby retain the latch in the closed position. Subsequent displacement of the latch to the open position requires the user to disengage the lug from the latch, which is likely to be difficult for a user who is under an approximate target age to achieve.

The use of a latch retainer in such embodiments may render displacement of the latch from the open position to the closed position more difficult due to resistance from the latch retainer. This is undesirable as such difficulty may dissuade some users from locking the scissors after use. However, as mentioned above, the use of the gate to displace the latch into the closed position provides additional leverage, which typically assists a user to overcome any extra resistance caused by the latch retainer.

The invention has application to hand held implements other than scissors. In another embodiment (not illustrated), the hand held implement is a pen. The loop portion is provided on the pen with a moveable section. The moveable section may cause an ink delivery device of the pen, such as the nib or ballpoint, to become retracted into the barrel of the pen. Thus, the nib of the pen is protected, and persons are protected from accidentally coming into contact with the nib thus avoiding ink marks on their clothes or skin.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A hand held implement including:

a loop portion;

the loop portion having a moveable section which is moveable from a first position in which it is contiguous with the loop portion to a second position wherein the loop portion is interrupted;

wherein movement of the moveable section activates a function of the hand held implement;

wherein the function activated by the moveable section includes a latching arrangement;

wherein the latching arrangement includes a latch which is slidably moveable;

wherein the implement is a pair of scissors having a pair of blades respectively connected to a pair of handles, at least one of the handles defining the loop portion, wherein the latch is disposed intermediate the handles; and wherein the scissors further have a scissor pivot for pivotally connecting the blades and the handles, and wherein the latch is disposed adjacent to an end of at least one of the handles proximate to the scissor pivot.

2. A hand held implement according to claim 1 wherein the moveable section can only move in a direction inwardly of the loop portion.

3. A hand held implement according to claim 1 wherein the moveable section is pivotally moveable.

4. A hand held implement according to claim 3 wherein the moveable section is mounted to the remainder of the loop portion by way of a pin and is arranged to pivot about the pin.

5. A hand held implement according to claim 1 wherein the latching arrangement operates to retain the blades in a closed position.

6. A hand held implement according to claim 1 wherein the moveable section includes at least one projection which activates the latching arrangement.

* * * * *